US006551146B2

(12) United States Patent
Nakamura

(10) Patent No.: US 6,551,146 B2
(45) Date of Patent: Apr. 22, 2003

(54) CONNECTOR AND A METHOD FOR ASSEMBLING A CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/074,465

(22) Filed: Feb. 12, 2002

(65) Prior Publication Data

US 2002/0160650 A1 Oct. 31, 2002

(30) Foreign Application Priority Data

Apr. 26, 2001 (JP) ..... 2001-130259

(51) Int. Cl.[7] ..... H01R 13/514
(52) U.S. Cl. ..... 439/752; 439/489
(58) Field of Search ..... 439/752, 489, 439/488, 352, 347

(56) References Cited

U.S. PATENT DOCUMENTS 5,928,038 A * 7/1999 Berg et al. ..... 439/752
5,934,946 A 8/1999 Nakamura
5,997,364 A 12/1999 Matsuoka et al.
6,368,164 B1 * 4/2002 Nakamura ..... 439/752
6,491,542 B1 * 12/2002 Zerebilov ..... 439/489

* cited by examiner

*Primary Examiner*—P. Austin Bradley
*Assistant Examiner*—Felix O. Figueroa
(74) *Attorney, Agent, or Firm*—Gerald E. Hespos; Anthony J. Casella

(57) ABSTRACT

A female housing (30) has cavities (32) for accommodating female terminal fittings and a retainer mounting hole (41) opens sideways across the cavities (32). A retainer (50) is mounted in the retainer mounting hole (41) and permits insertion and withdrawal of the female terminal fittings into and from the cavities (32) and projects from the side surface of the female housing (30) in a partial locking position. However, the retainer (50) is flush with the side surface of the female hosuing (30) in a full locking position. A slider (60) is fitted around the female housing (30) for movement, so that the housing (30) and the slider (60) are in sliding contact with each other. The slider (60) is formed with a retainer insertion hole (68) that can communicate with the retainer mounting hole (41). When the retainer (50) is insufficiently inserted, a detecting portion (69) interferes with a projecting portion (69) of the retainer (50) to restrict the movement of the slider (60).

17 Claims, 12 Drawing Sheets

CONNECTOR AND A METHOD FOR ASSEMBLING A CONNECTOR

BACKGROUND OF THE INVENTION

1. Field of the Invention

The invention relates to a connector with a retainer and a method for assembling such a connector.

2. Description of the Related Art

A known connector has a housing with cavities for accommodating terminal fittings. The housing also has a retainer mounting hole that opens in one side surface of the housing and crosses the cavities. A retainer can be mounted in the retainer mounting hole either at a partial locking position or at a full locking position. The retainer is configured to permit insertion and withdrawal of the terminal fittings into and from the cavities when the retainer is in the partial locking position. However, the retainer is configured to lock the terminal fittings in the cavities when the retainer is at the full locking position. As a result, the retainer is mounted at the partial locking position and the terminal fittings are inserted into the cavities. The retainer then is pushed to a full locking position to lock the terminal fittings in the cavities.

The retainer could be pushed insufficiently from the partial locking position to the full locking position, and the terminal fittings may be left unlocked if the insufficient insertion of the retainer is overlooked. In view of the above, an object of the invention is to detect insufficient insertion of a retainer.

SUMMARY OF THE INVENTION

The invention is directed to a connector with first and second housings. The first housing has cavities for receiving terminal fittings and a retainer mounting hole that opens sideways across the cavities. A retainer is mounted in the retainer mounting hole and enters the cavities to lock the terminal fittings. A slider is mounted on the first housing for movement along a connecting and separating direction of the housings. Biasing means may be provided in the first housing to bias the slider toward the second housing.

The slider comprises a detecting portion for detecting whether the retainer is inserted sufficiently. More particularly, a retainer that has been inserted to a proper depth preferably is substantially flush with the side surface of the first housing. However, a retainer that has not been inserted to a proper depth projects from the side surface. The detecting portion preferably is in sliding contact with the side surface of the first housing that has the retainer mounting hole and detects an insufficient insertion of a retainer by interfering with a retainer that projects outwardly beyond the retainer mounting hole.

The second housing preferably comprises a resilient engaging portion that is resiliently deformable between a first position and a second position when the housings are connected properly.

The resilient engaging portion preferably is resiliently deformable in a direction that intersects the connecting and separating direction of the first and second housings.

The resilient engaging portion that is in the first position is engageable with the slider to push the slider against the biasing force of the biasing means while the connector housings are being connected. The resilient engaging portion that is in the second position is disengaged from the slider along the connecting and separating direction of the first and second housings when the housings are connected properly with each other.

The resilient engaging portion is displaced resiliently to the engaging position as the housings are connected. Thus, the resilient engaging portion pushes the slider back against the biasing force of the biasing means. If a connecting operation is interrupted at an intermediate stage of connection, the biasing force accumulated in the biasing means is released to separate the housings from each other. As a result, the partial connection of the housings can be detected. The resilient engaging portion is displaced resiliently to the disengaging position when the housings are connected properly. Thus, the biasing force of the biasing means is released to move the slider forward.

The retainer is mounted into the first housing before the connecting operation. A retainer that has been inserted to proper depth is substantially flush with the side surface of the first housing. Accordingly, the detecting portion of the slider and the retainer do not interfere and the slider is permitted to move. On the other hand, a retainer that has been inserted insufficiently projects from the side surface of the first housing. Thus, the detecting portion of the slider interferes with the projecting portion of the retainer to restrict the movement of the slider. In other words, the insufficient insertion of the retainer can be detected based on whether the slider is movable.

The slider preferably is frame-shaped and substantially surrounds at least part of the outer surface of the first housing, preferably over substantially the entire circumference.

An operable portion preferably is formed on the slider for moving the slider back and away from the second housing. The operable portion is spaced from a leading end of the second housing when the two connector housings are connected properly. Thus, the operable portion can be engaged easily by hand for manipulating the slider.

A retainer insertion hole is formed in a portion of the slider that would otherwise cover the retainer mounting hole. Thus, the retainer can be inserted through the retainer insertion hole and into the retainer mount hole when the slider is assembled on the first housing. Insufficient insertion of the retainer can be detected based on whether the edge of the retainer insertion hole interferes with the retainer to restrict the movement of the slider. Thus, an edge of the retainer insertion hole forms the detecting portion.

The invention also is directed to a method of assembling a connector comprising inserting terminal fittings into cavities of a first housing. The method also includes inserting a retainer into a retainer mounting hole in the first housing, which is open sideways across the cavities, to lock the terminal fittings in the cavities. The method then comprises detecting whether the retainer is inserted insufficiently by means of a detecting portion of a slider provided for forward and backward movement along a connecting and separating direction of the first housing with a mating second housing.

The method may further comprise at least partly connecting the first housing with a second housing thereby bringing a resilient engaging portion in the second housing into engagement with a portion of the first housing to displace the resilient engaging portion from a second position where it is not engageable with the slider along connecting and separating directions of the housings to a first position where it is engageable with the slider along the connecting and separating directions.

Preferably, the slider surrounds at least two outer surfaces of the first connector housing.

The slider that is engaged with the resilient engaging portion is moved back both at an intermediate stage of connecting the housings and at an intermediate stage of separating the connector housings. When the housings are connected properly, the resilient engaging portion is not engageable with the slider along the connecting and separating directions and is displaced resiliently to the second position. Thus, the slider is moved forward.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 8A:
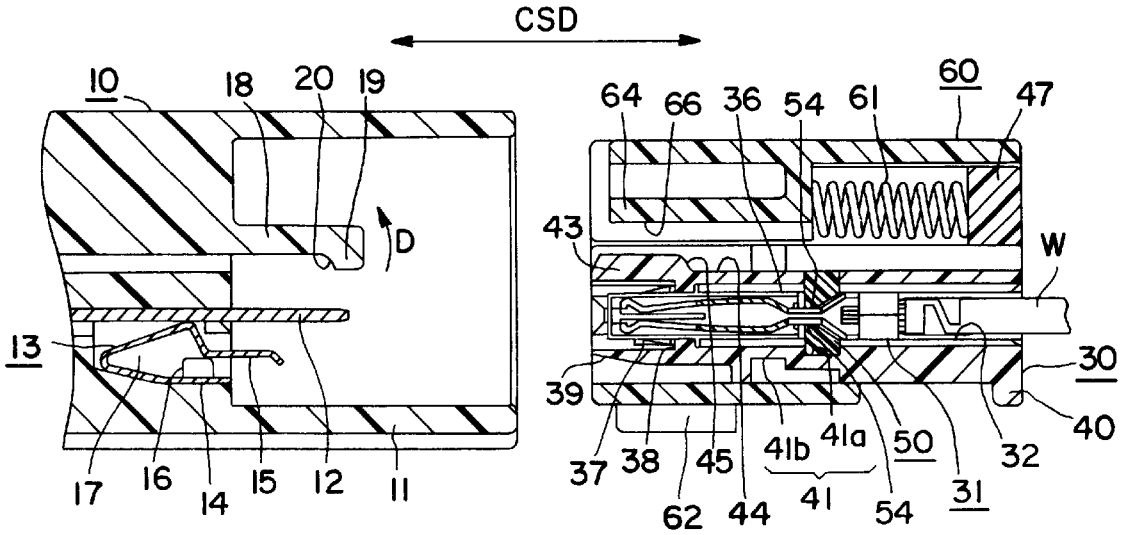
FIGS. 8A and 8B are sections along 5A—5A, 5B—5B of FIG. 2 to show the female housing having the retainer mounted in a full locking position and along 8A—8A, 8B—8B of FIG. 1 to show the male housing.
Figure 8B:
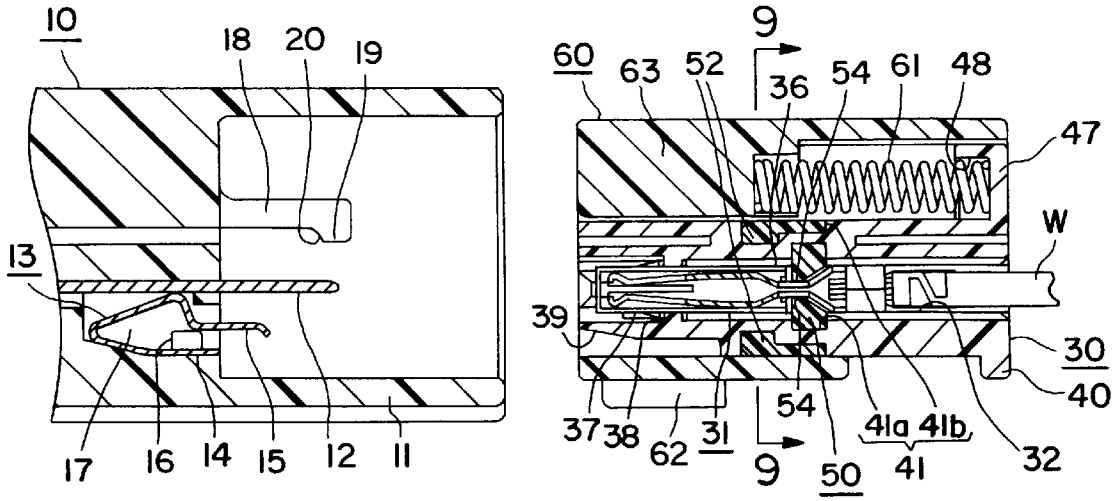

A connector according to the invention is comprised of a male housing 10 and a female housing 30 that are connectable to one another, as shown in FIGS. 8A and 8B. In the following description, sides of the housings 10, 30 to be connected with each other are referred to as the front.

Figure 1:
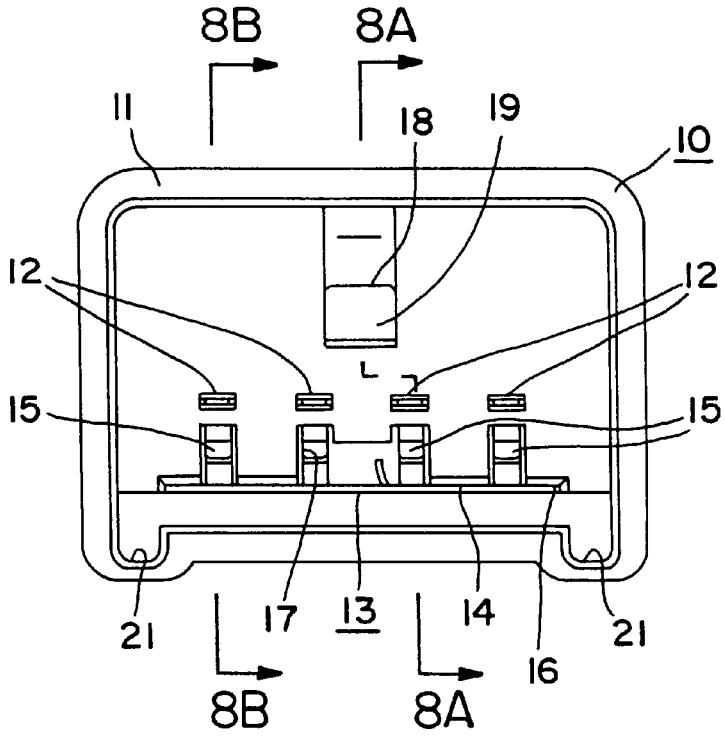
FIG. 1 is a front view of a male housing of a connector according to one embodiment of the invention.

The male housing 10, as shown in FIGS. 1 and 8, is formed of synthetic resin and includes a substantially rectangular tubular receptacle 11 that projects integrally or unitarily forward from a wall of a piece of equipment. Four male tab terminals 12 are arranged substantially side by side and project into the receptacle 11 from a back wall of the male housing 10.

A shorting terminal 13 is at the back wall of the male housing 10 below the male tab terminals 12. The shorting terminal 13 has a substantially plate-shaped main portion 14 pressed into a mount groove 16 in the back wall of the male housing 10, and four resilient contact pieces 15 are folded at the rear end of the main portion 14 to project forward. The resilient contact pieces 15 are accommodated in recesses 17 that face the respective male tab terminals 12. Thus the resilient contact pieces 15 are held resiliently in contact with the respective male tab terminals 12. In this way, the four male tab terminals 12 can be shorted with each other so as to cause no potential difference among them. The front ends of resilient contact pieces 15 are bent down in the receptacle 11 to facilitate resilient deformation away from the male tab terminals 12 during connection of the male and female housings 10 and 30.

A lock arm 18 cantilevers from a substantially widthwise center position of the back wall of the male housing 10 above the male tab terminals 12. The lock arm 18 projects slightly more forward than the male tab terminals 12, and is resiliently or elastically deformable in a direction D about its base end along the vertical direction in FIGURES. The direction D intersects the connecting and separating directions CSD, and preferably is substantially normal to the connecting and separating directions CSD. A hook 19 projects down at the free end of the lock arm 18 and has a rear end surface 20 that can be engaged with a surface of the female housing 30, as described later. Further, guide recesses 21 are formed at opposite sides of the bottom of the receptacle 11.

Figure 2:
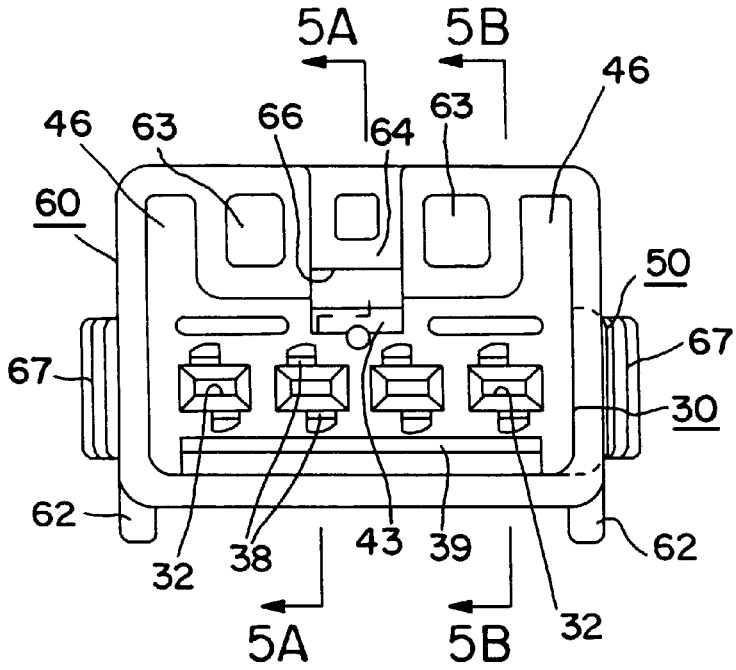
FIG. 2 is a front view of a female housing.
Figure 5A:
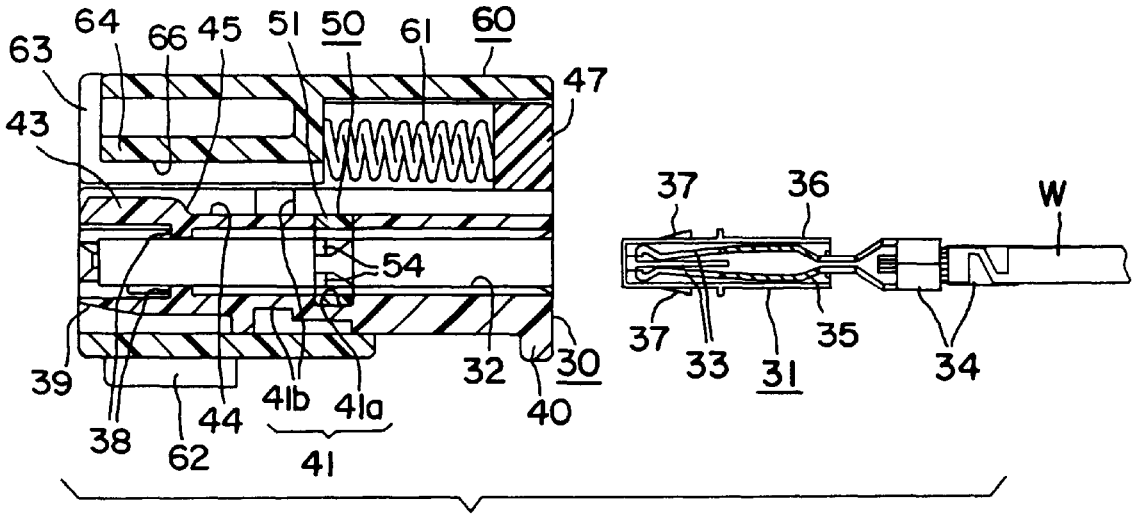
FIGS. 5A and 5B are sections along 5A—5A, 5B—5B of FIG. 2 showing a state where a retainer is mounted in a partial locking position on a female housing, respectively.

The female housing 30 is formed into a block-shape from a synthetic resin, as shown in FIGS. 2 and 5(A). Four cavities 32 penetrate through the female housing 30 in forward and backward directions and in positions that substantially align with the male tab terminals 12. The cavities 32 accommodate female terminal fittings 31 connected with ends of wires W. Each female terminal fitting 31 has opposite front and rear ends. A barrel 34 is formed at the rear end and is configured for crimped, folded or bent connection with the wire W. A terminal main body 35 is formed at the front end of the female terminal fitting 31 and has a resilient contact piece 33 that can be brought resiliently or elastically into contact with the corresponding male tab terminal 12. The female terminal fitting 31 further includes a box 36 that surrounds the terminal main body 35, and metal locks 37 project from the upper and lower surfaces of the box 36. Forwardly open locking grooves 38 are formed in the ceiling and bottom surfaces of each cavity 32 for engagement by the metal locks 37. Engaging recesses 39 are provided along the widthwise direction at the front end of the bottom surface of the female housing 30 and are engageable with the respective resilient contact pieces 15 of the shorting terminal 13 in the male housing 10. Surfaces of the engaging recesses 39 that engage the resilient contact pieces 15 slope down and away from the female terminal fittings 31 to the right in FIG. 5. Thus, the resilient contact pieces 15 are smoothly resiliently deformable down and away from the female terminal fittings 31. A rib 40 extends along the widthwise direction at the rear end of the bottom surface of the female housing 30 and defines a surface for pushing the female housing 30 into connection with the male housing 10.

Figure 3:
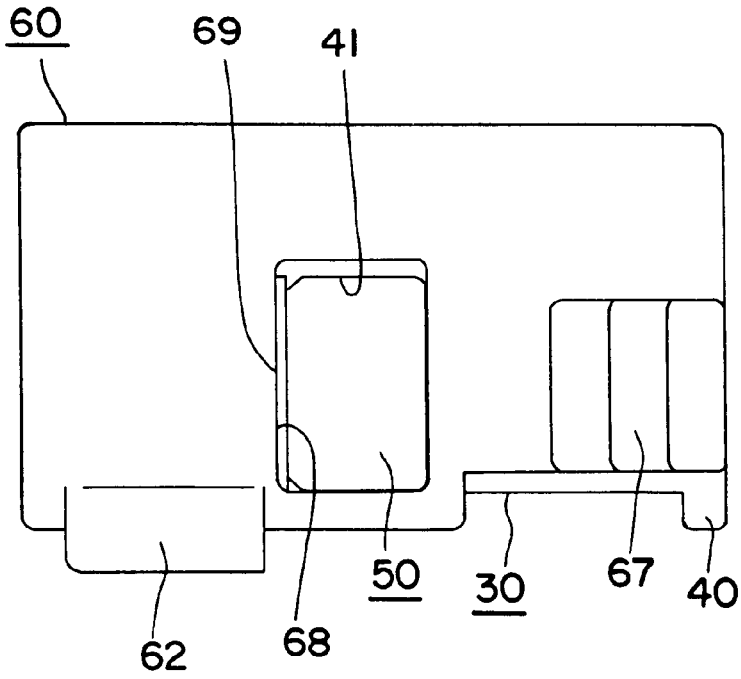
FIG. 3 is a side view of the female housing.
Figure 5B:
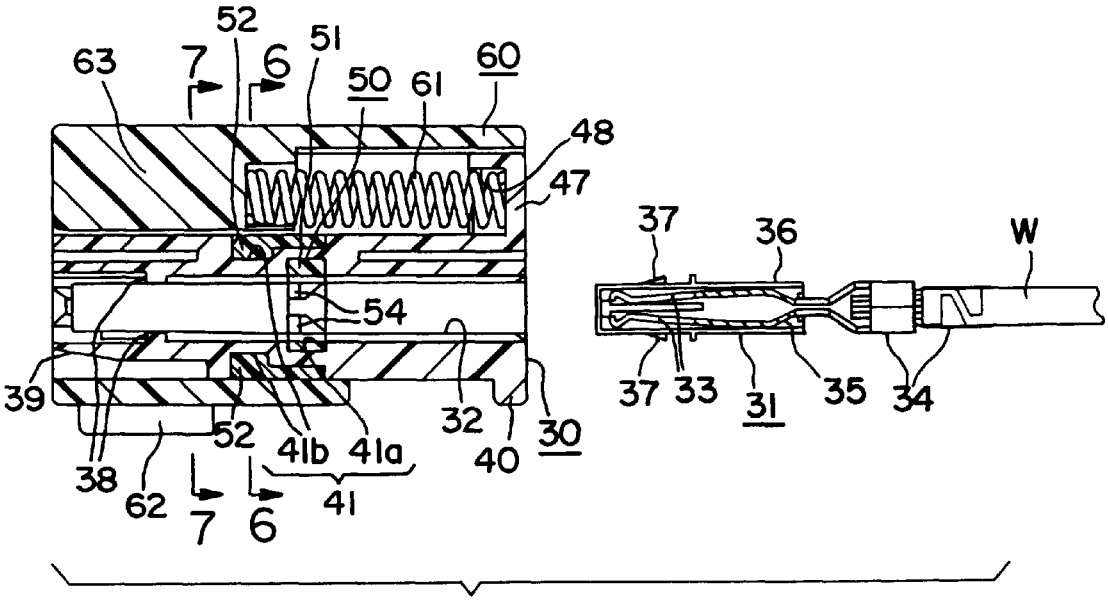

A retainer mounting hole 41 is formed at a longitudinally central position in one side surface of the female housing 30, as shown in FIGS. 3 and 5(B), and is configured to accommodate a retainer 50. The retainer mounting hole 41 communicates with the respective cavities 32, and includes a base inserting portion 41*a* and holding arm inserting portions 41*b* which are recessed from the upper and bottom surfaces of the female housing 30.

Figure 6:
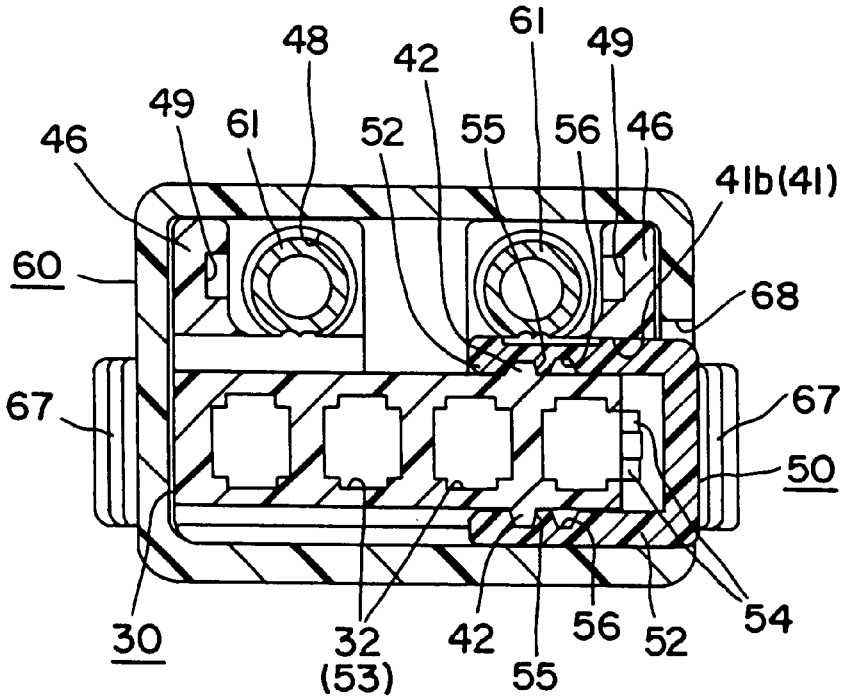
FIG. 6 is a section along 6—6 of FIG. 5(B).
Figure 9:
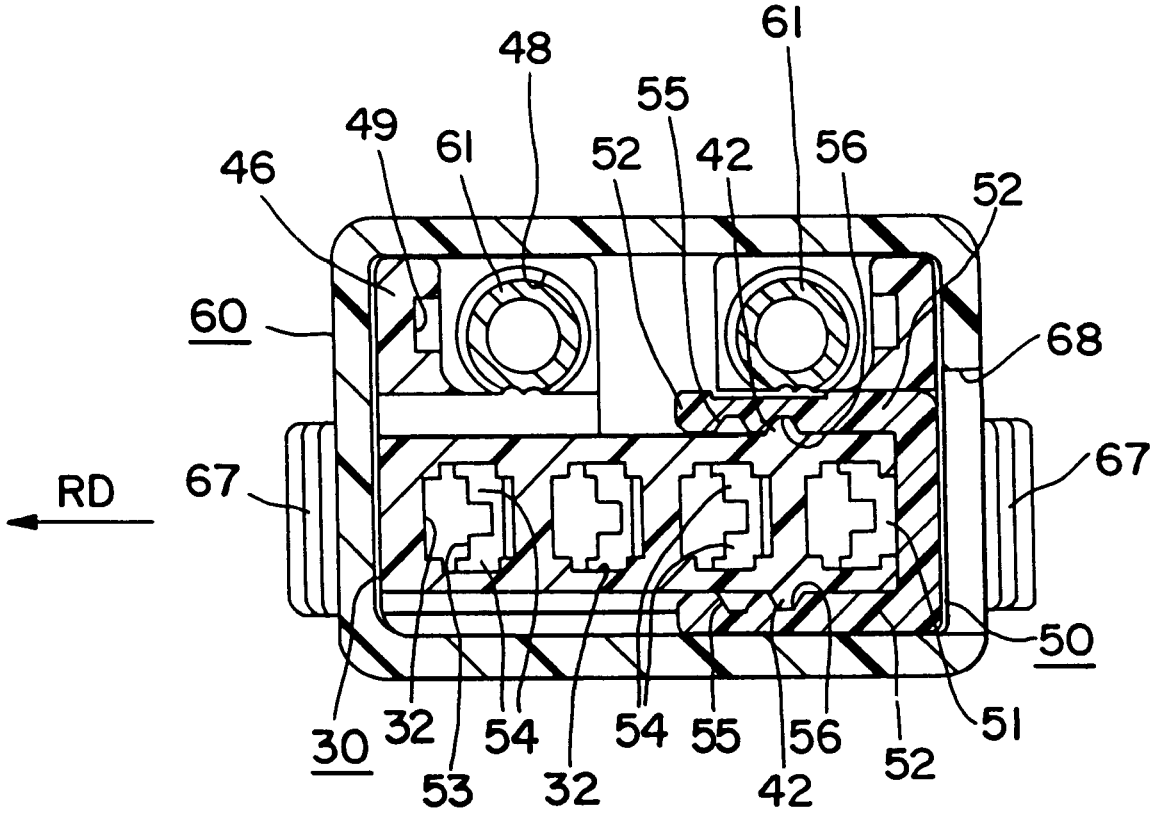
FIG. 9 is a section along 9—9 of FIG. 8(B).

The retainer 50, as shown in FIG. 6, is comprised of a substantially flat base 51 with substantially the same length as the width of the female housing 30. Two holding arms 52 extend from the upper and bottom surfaces of the base 51 substantially parallel with the base 51. The base 51 has four insertion holes 53 that align with the respective cavities 32. Upper and lower locks 54 are formed at the front edge of each insertion hole 53 with respect to a mounting direction of the retainer 50 and engage with the rear end of the box 36 of the corresponding female terminal fitting 31, as shown in FIG. 9. Two holding recesses 55, 56 are formed in the inner surface of each holding arm 52 and are arranged side by side in the widthwise or mounting direction RD of the retainer 50. The retainer 50 can be held in a partial locking position or a full locking position by the engaging the holding recesses 55, 56 with holding projections 42 that project from the outer surfaces of the holding arm inserting portions 41*b* of the retainer mounting hole 41. Thus, the retainer 50 is movable between these two positions along the mounting direction RD of the retainer 50 which is substantially normal to the insertion and withdrawal direction of the female terminal fittings 31 into and from the female connector housing 30.

The retainer 50 is held in the partial locking position by engaging the holding recesses 55 at the back side with respect to the mounting direction of the retainer 50 with the holding projections 42. In this partial locking position, the insertion holes 53 communicate with the cavities 32 and the locks 54 are retracted from the cavities 32, as shown in FIGS. 5 and 6, to permit insertion and withdrawal of the female terminal fittings 31 into and from the cavities 32. At this stage, a front end of the retainer 50 with respect to its mounting direction projects from the outer surface of the female housing 30, as shown in FIG. 6. The retainer 50 is held in the full locking position by engaging the holding recesses 56 at the front side with respect to the mounting direction RD of the retainer 50 with the holding projections 42. In this full locking position, the locks 54 project into the cavities 32 and engage the rear ends of the boxes 36 of the female terminal fittings 31, as shown in FIGS. 8 and 9, to hold the female terminal fittings 31 so as not to come out. At this stage, the front end of the retainer 50 with respect to its mounting direction is in the retainer mounting hole 41, and the outer surface of the retainer is flush with the outer surface of the female housing 30, as shown in FIG. 9. Thus, the female terminal fitting 31 can be locked doubly in the cavities 32 by the retainer 50.

A lock 43 is formed at substantially the widthwise center of the front upper surface of the female housing 30, and a locking groove 44 extends back from the lock 43, as shown in FIG. 5(A). The lock arm 18 of the male housing 10 resiliently deforms and moves onto the lock 43 as the housings 10, 30 are fitted to each other. The hook 19 of the lock arm 18 enters the locking groove 44 when the housings 10, 30 are connected to a proper depth and the rear end surface 20 of the hook 19 engages a rear end surface 45 of the lock 43 at the front end of the locking groove 44. A slanted surface 43*a* is formed on the front end of the lock 43 for guiding the lock arm 18 onto the lock 43, and the upper surface of the lock 43 is substantially at the same height as the lower surface of the lock arm 18. The rear end surface 20 of the hook 19 and the rear end surface 45 of the lock 43 are sloped moderately upward to the left in FIGURES, thereby forming a semi-locking construction or releasable locking construction. Thus, a specified force to separate the locked housings 10, 30 causes the lock arm 18 to be guided resiliently up by the slanted rear end surfaces 20, 45 out of the locked state. Further, the holding arm inserting portion 41*b* of the retainer mount hole 41 communicates with the locking groove 44 as shown in FIG. 8. The hook 19 of the lock arm 18 enters the locking groove 44 when the housings 10, 30 are connected properly and does not interfere with the holding arm 52 of the retainer 50 entering the locking groove 44 in the full locking position (see FIG. 12).

Figure 4:
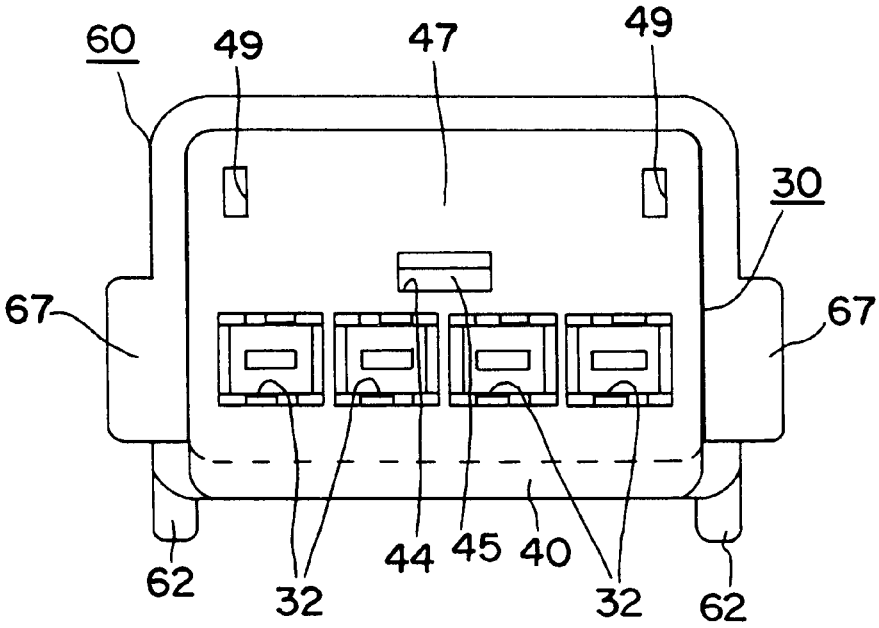
FIG. 4 is a rear view of the female housing.
Figure 7:
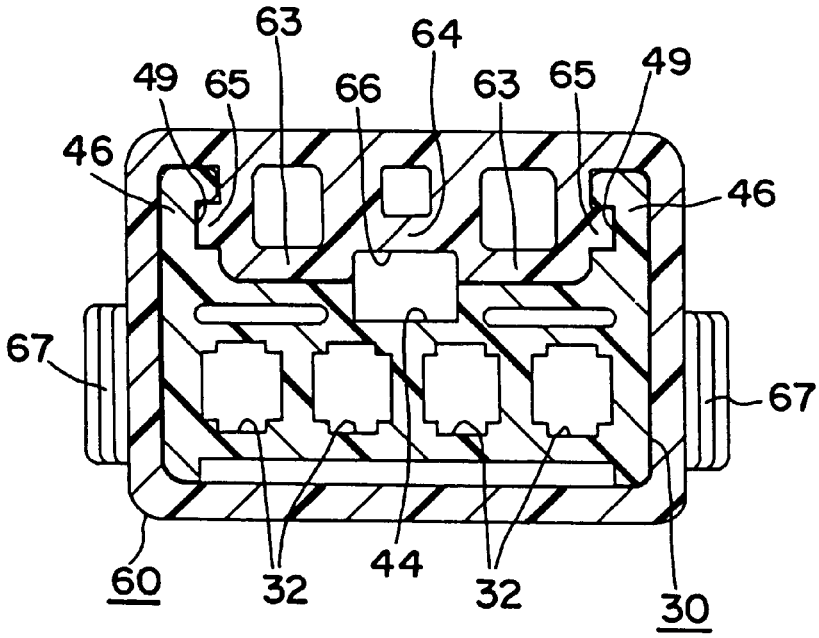
FIG. 7 is a section along 7—7 of FIG. 5(B).

Side walls 46 project from the upper surface of the female housing 30 and extend forward and backward over substantially the entire length of the female housing 30, as shown in FIGS. 2, 6 and 7. A rear wall 47 connects the rear ends of the side walls 46 at the rear end as shown in FIGS. 4 and 5.

A slider 60 is assembled with the female housing 30 together with a pair of compression coil springs 61. More particularly, the slider 60 preferably is made of a synthetic resin, and is substantially in the form of a rectangular frame for surrounding all outer surfaces of the female housing 30, as shown in FIG. 2. Additionally, the slider 60 has a length substantially equal to the length of the female housing 30, as shown in FIG. 3. The slider 60 is movable forward and backward along the connecting and separating directions CSD of the housings 10, 30, and its inner surfaces are held in sliding contact with the outer surfaces of the female housing 30 during this movement. Two guide ribs 62 project at the opposite bottom side edges of the slider 60 and enter the guide recesses 21 of the male housing 10 to guide the slider 60. A lower portion of the slider 60 behind the retainer 50 is cut away to avoid interference with the rib 40 of the female housing 30 during movement of the slider 60.

An upper part of the slider 60 bulges into the space between the opposite side walls 46, as shown in FIG. 2. Opposite sides of the bulge adjacent the opposite side walls 46 define spring pressing portions 63 and a center portion of the bulge defines an engageable portion 64. The spring pressing portions 63 have recessed rear ends, as shown in FIG. 5(B), to support the front of the compression coil springs 61. The compression coil springs 61 have their rear ends in spring recesses 48 in the rear wall 47 of the female housing 30. The springs 61 are compressed slightly between the spring pressing portions 63 and the rear wall 47. Accordingly, the slider 60 is biased forwardly by the compression coil springs 61 in the female connector housing 30. The side surfaces and the bottom surfaces of the spring pressing portions 63 are held near or in contact with the inner side surfaces of the side walls 46 and the upper surface of the female housing 30, as shown in FIG. 2. Stopper projections 65 project from the outwardly facing side surfaces of the spring pressing portions 63, as shown in FIG. 7. Thus, the slider 60 is stopped at a front limit position by the entrance of the stopper projections 65 in the stopper grooves 49 in the inner surfaces of the side walls 46 and the engagement of the stopper projections 65 with the front ends of the stopper grooves 49.

Figure 10A:
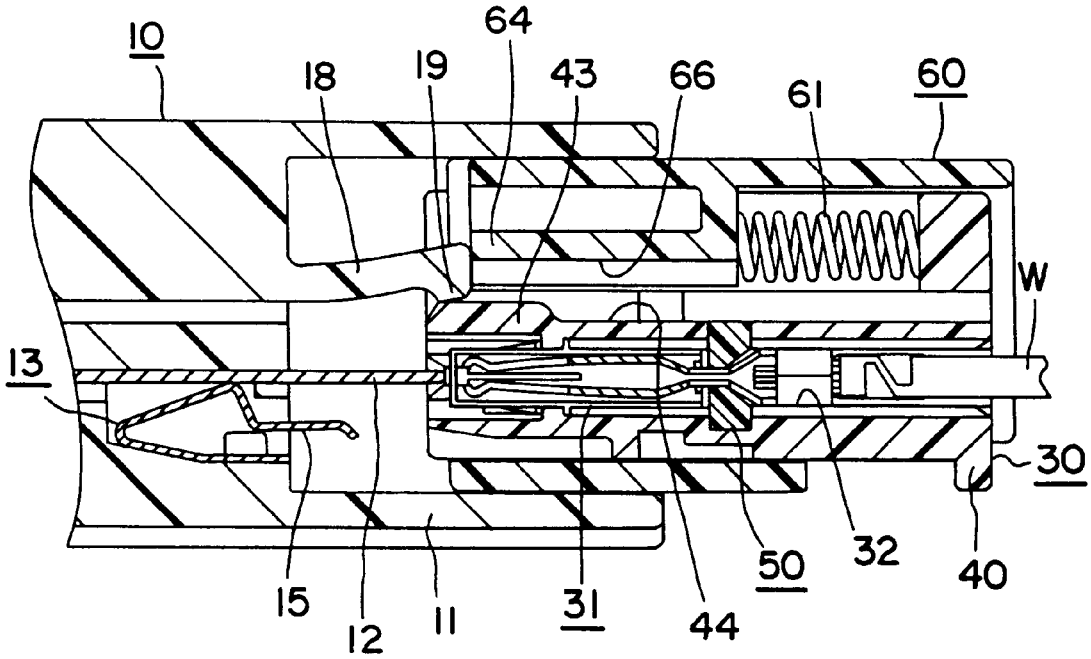
FIGS. 10A and 10B are sectional views similar to FIGS. 8A and 8B, but showing a state where a lock arm is resiliently deformed to engage a slider.
Figure 12A:
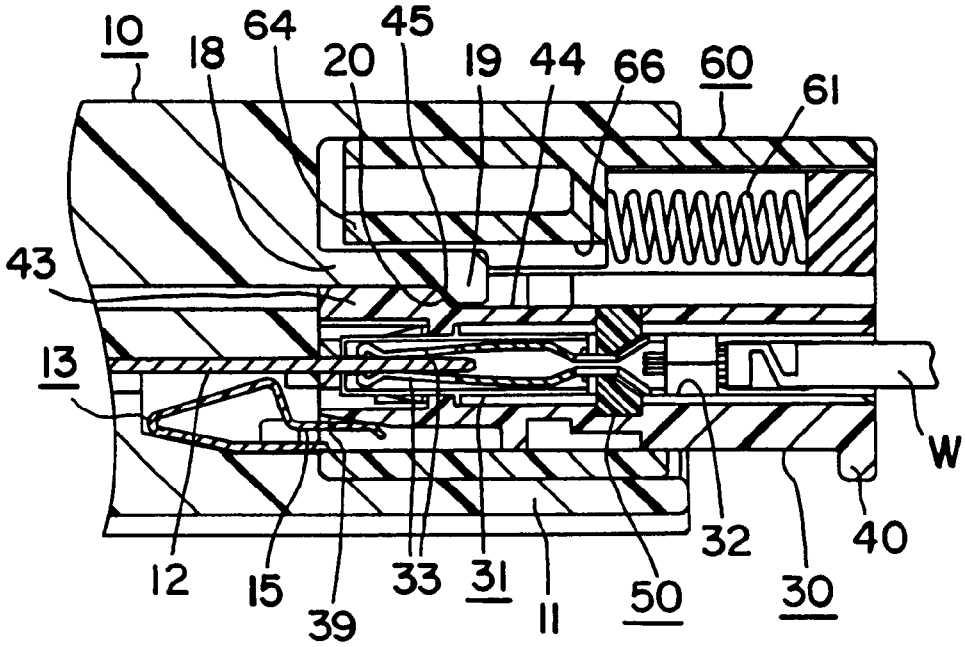
FIGS. 12A and 12B are sectional views similar to FIGS. 8A and 8B, but showing a state where the housings are connected properly.

The front end surface of the engageable portion 64 is behind the front end surfaces of the spring pressing portions 63, as shown in FIG. 5(A). Additionally, the front end surface of the lock arm 18 is engageable with the engageable portion 64 at an intermediate stage of connection of the housings 10, 30. An escape recess 66 is formed in the bottom of the engageable portion 64 to provide a space above the upper surface of the female housing 30, and the upper surface of this escape recess 66 is slightly higher than the upper surface of the lock arm 18 in its natural state as shown in FIG. 8(A). Accordingly, the engageable portion 64 is engageable with the front end surface of the hook 19 of the lock arm 18. Thus, the lock arm 18 deforms resiliently to move onto the lock 43 during the connection of the housings 10, 30 and is brought to an engaging position, as shown in FIG. 10(A). The lock arm 18 is disengaged from the lock 43 and is restored resiliently or elastically to substantially its natural state when the housings 10, 30 are properly connected with each other at the disengaging position as shown in FIG. 12(A). Further, as shown in FIG. 2, cut-away portions are formed in the centers of the front end surfaces of the engageable portion 64 and the spring pressing portions 63, and are open forward.

Figure 13:
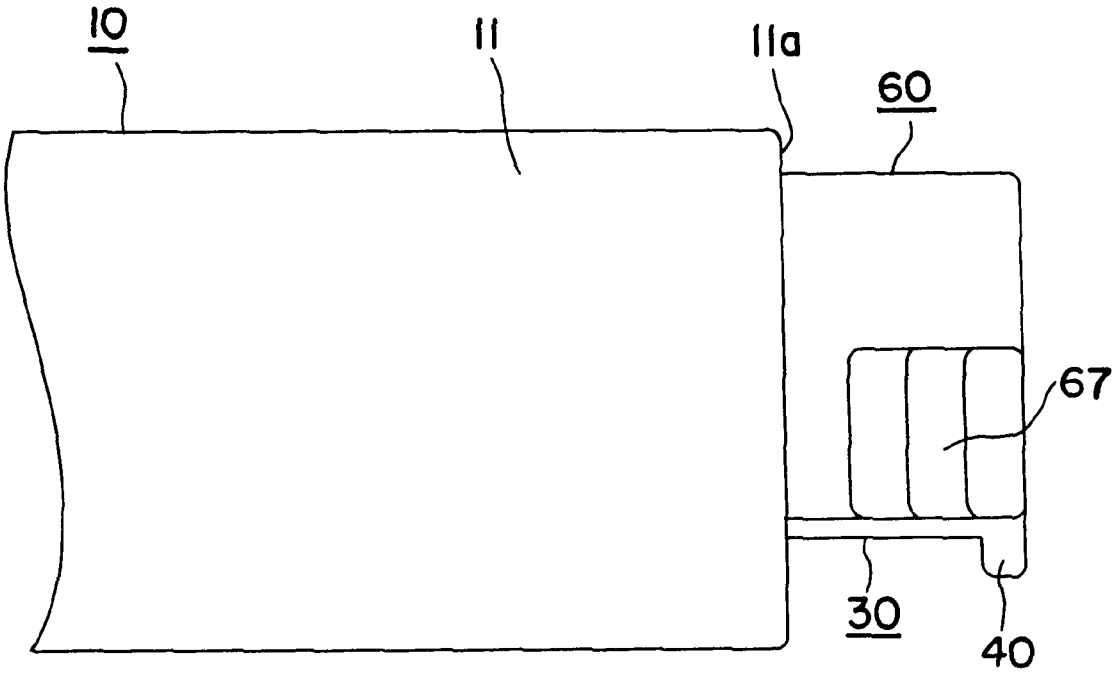
FIG. 13 is a side view showing the state of FIG. 12.

Operable portions 67 project sideways from the opposite outer side surfaces of the slider 60, as shown in FIGS. 2, 3 and 4, and are used to move the slider 60. The operable portions 67 are at the same height as the cavities 32 and are symmetrically disposed on the outer side surfaces of the slider 60 so that an operator can hold the operable portions 67 with the fingers of one hand. Each operable portion 67 has three steps that project out to larger degrees toward the back. The operable portions 67 are at the rear of the slider 60, and hence are spaced back from the front end surface 11*a* of the receptacle 11 of the male housing 10 when the housings 10, 30 are connected properly, as shown in FIG. 13. Therefore, a space exists between the operable portions 67 and the male housing 10 so that fingers easily can be placed on the operable portions 67.

A retainer insertion hole 68 is formed through the slider 60 and exposes the retainer mounting hole 41 in the side surface of the female housing 30, as shown in FIG. 3. The retainer insertion hole 68 is a substantially rectangular window and is slightly wider than the retainer mount hole 41. Thus, the retainer insertion hole 68 enables insertion of the retainer 50 through the slider 60 and into the retainer mounting hole 41. The retainer 50 can be mounted in the partial locking position so that the front end of the retainer 50 projects from the side surface of the female housing 30 and is located in the retainer insertion hole 68, as shown in FIG. 6. Thus, an attempt to move the slider 60 backward in this state causes the front edge of the retainer insertion hole 68 to interfere with the projecting portion of the retainer 50, thereby restricting movement of the slider 60. On the other hand, a retainer 50 that is inserted to the full locking position is accommodated completely in the retainer mounting hole 41, as shown in FIG. 9, and is no longer in the retainer insertion hole 68. Hence, backward movement of the slider 60 is permitted because the front edge of the retainer insertion hole 68 does not interfere with the retainer 50. In other words, the mounted state of the retainer 60 can be detected based on whether the backward movement of the slider 60 is permitted, and the front edge of the retainer insertion hole 68 serves as a detecting portion 69.

The female housing 30 is assembled by inserting the two compression coil springs 61 into the spring accommodating recesses 48 of the female housing 30, as shown in FIG. 5(B), and mounting the slider 60 onto the female housing 30 from the front. The stopper projections 65 of the slider 60 enter the stopper grooves 49 on the inner side surfaces of the side walls 46 of the female housing 30. The slider 60 is biased by the springs 61 into a proper position with stopper projections 65 engaged with the front end surfaces of the stopper grooves 49 and with the front and rear end surfaces of the slider 60 aligned with the front and rear ends of the female housing 30. At this stage, the retainer insertion hole 68 is substantially in alignment with the retainer mounting hole 41, as shown in FIG. 3.

The retainer 50 then is inserted through the retainer insertion hole 68 of the slider 60 and into the partial locking position in the retainer mounting hole 41, as shown in FIGS. 5 and 6. The female terminal fittings 31 connected with the wires W then are inserted into the cavities 32 from behind. Thus, the metal locks 37 of the female terminal fittings 31 engage the rear end surfaces of the locking grooves 38 to partly lock the female terminal fittings 31, as shown in FIG. 8. The retainer 50 is pushed to the full locking position by inserting a finger, a jig or the like into the retainer insertion hole 68 after the female terminal fittings 31 have been inserted. Thus, the locks 54 directly engage the rear ends of the boxes 36 of the female terminal fittings 31, as shown in FIGS. 8 and 9, thereby fully locking the female terminal fittings 31. The retainer 50 could be pushed insufficiently so that the retainer 50 does not reach the full locking position. As a result the locks 54 incompletely lock the boxes 36.

Figure 10B:
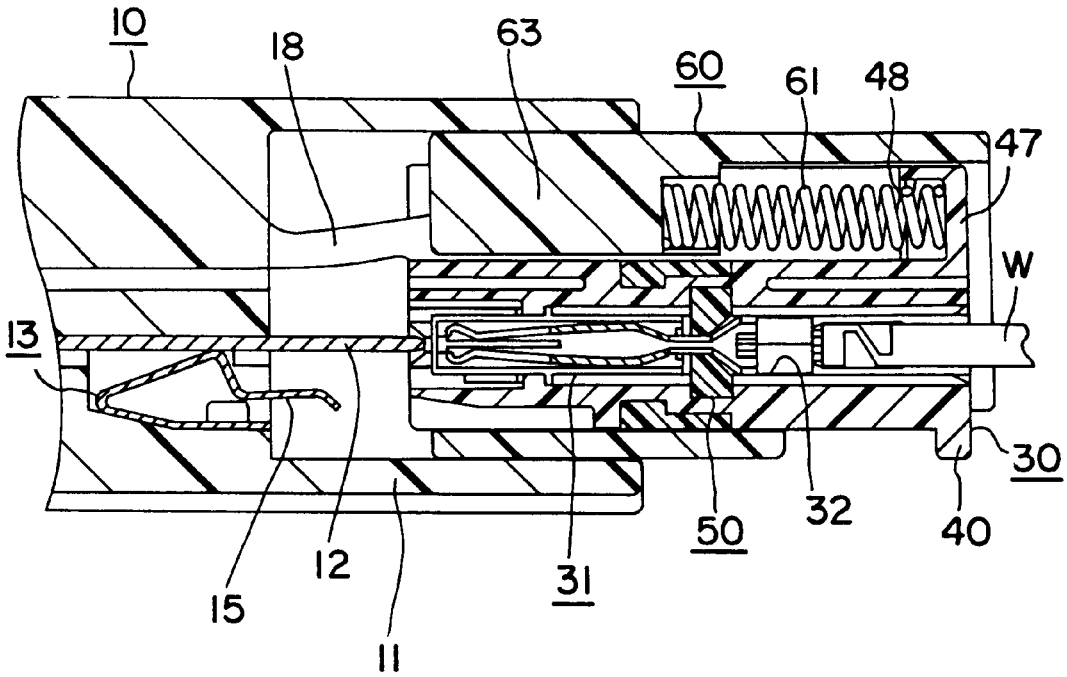

The housings 10, 30 are connected to one another after the female housing 30 is assembled completely. More particularly, the female housing 30 and the slider 60 are fit into the receptacle 11 of the male housing 10 from the front by pushing the rib 40 near the rear end of the female housing 30. This causes the guide ribs 62 of the slider 60 to enter the guide recesses 21 of the receptacle 11 for guiding the connecting operation. The lock arm 18 engages the slanted front surface 43*a* of the lock 43 before the male tab terminals 12 project into the cavities 32 of the female housing 30. Thus, the lock arm 18 is deformed resiliently to the engaging position and moves onto the lock 43, as shown in FIG. 10. The lock arm 18 then contacts the engageable portion 64 of the slider 60 and pushes the slider 60 back as the connection proceeds.

The front edge 69 of the retainer insertion hole 68 of the slider 60 interferes with the front end of a retainer 50 that had been inserted insufficiently and located in the retainer insertion hole 68. As a result, backward movement of the slider 60 is restricted and the connecting operation of the housings 10, 30 is hindered. Consequently, the female housing 30 is pulled out of the male housing 10, the retainer 50 is pushed to the full locking position to lock the female terminal fittings 31 securely and then the connecting operation is resumed. Although the insufficient insertion of the retainer 50 is detected during the connecting operation, it may also be detected by checking whether the slider 60 can be moved back before the connecting operation is started. Such a detection avoids interruption of the connecting operation.

Figure 11A:
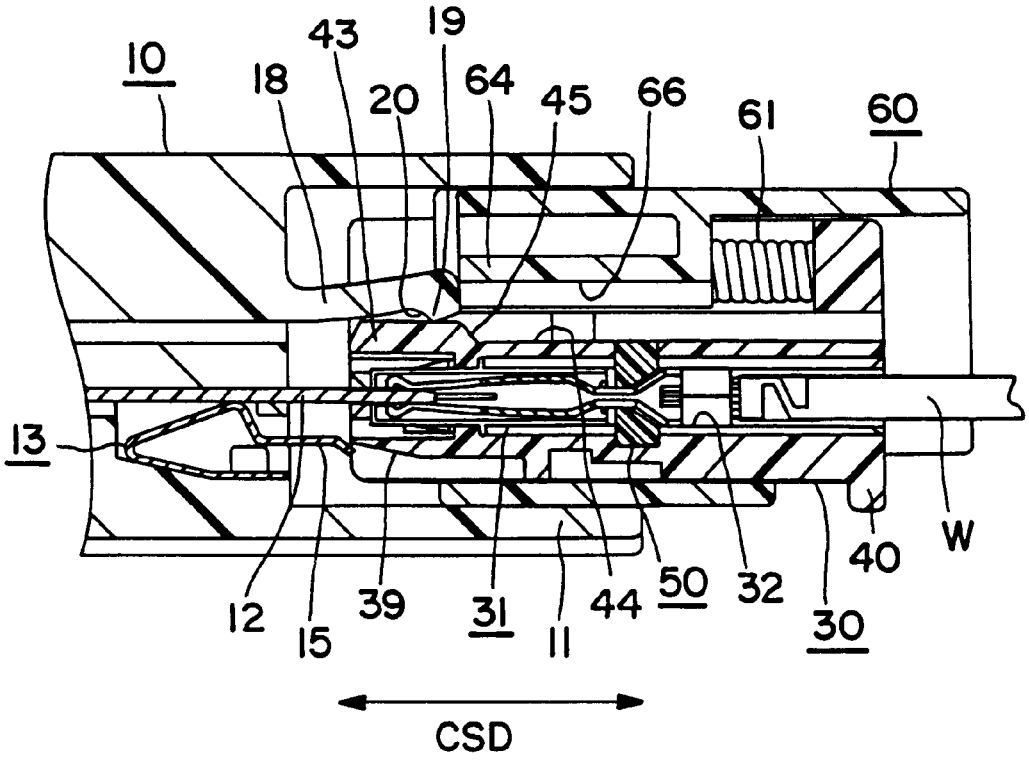
FIGS. 11A and 11B are sectional views similar to FIGS. 8A and 8B, but showing a state where the slider is pushed backward by the lock arm.
Figure 11B:
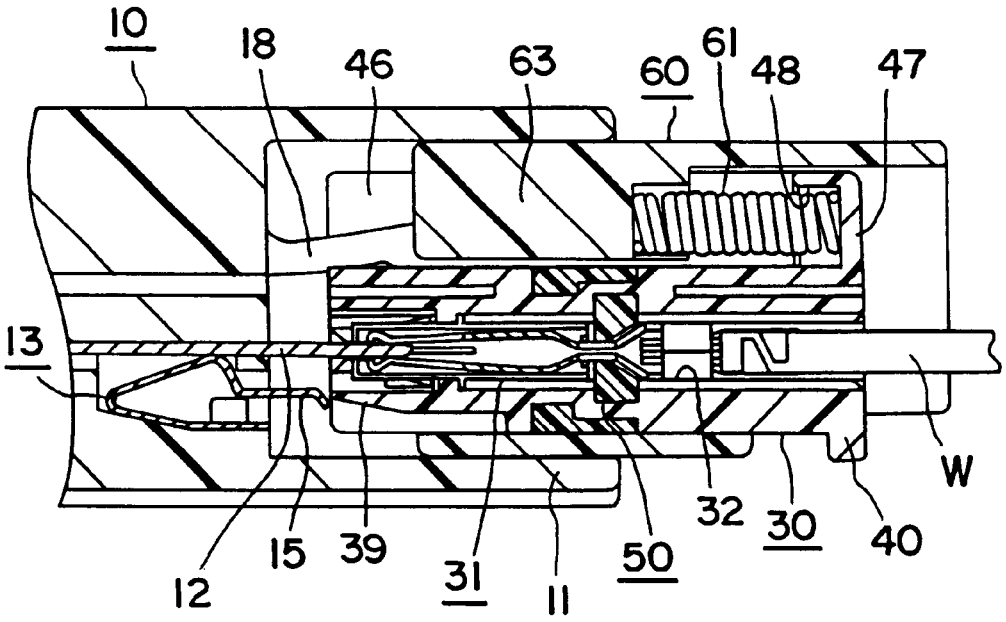

If the retainer 50 is mounted in the full locking position, the lock arm 18 pushes the slider 60 back against biasing forces of the compression coil springs 61 as shown in FIG. 11. The connecting operation could be interrupted for some reason at an intermediate stage of connection. Thus, spring forces accumulated in the resiliently compressed coil springs 61 are released and the forwardly biased slider 60 pushes the lock arm 18 to separate the housings 10, 30. This prevents the housings 10, 30 from being left partly connected.

Figure 12B:
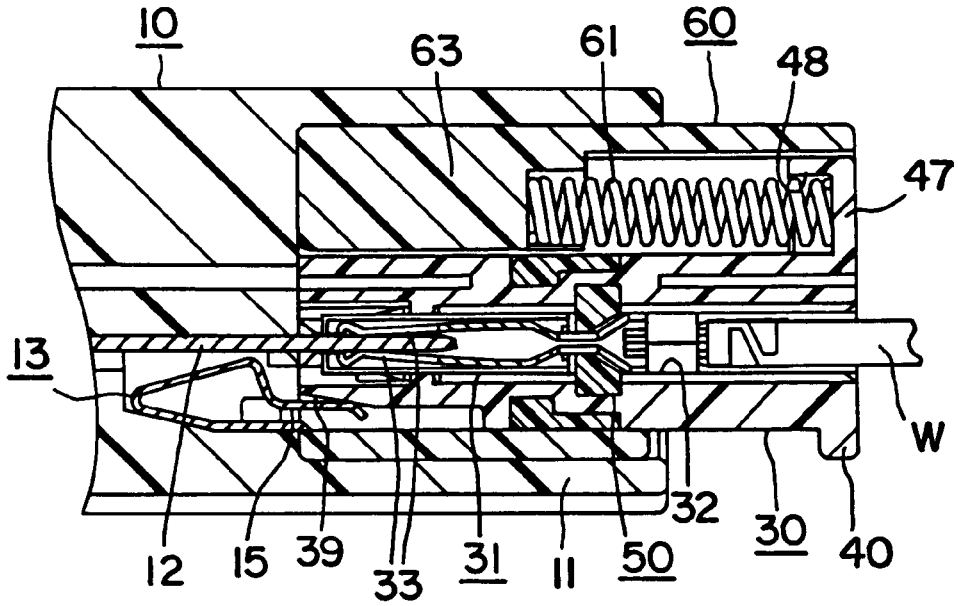

The engaging recesses 39 of the female housing 30 engage the resilient contact pieces 15 of the shorting terminal 13, as the connecting operation continues. Hence the resilient contact pieces 15 deform resiliently down and away from the male tab terminals 12 and the shorted state of the male tab terminals 12 is canceled (see FIG. 12). The terminal fittings 12, 31 are connected electrically when the housings 10, 30 are connected to a proper depth. At this time, the hook 19 of the lock arm 18 enters the locking groove 44, and the lock arm 18 is restored resiliently toward a disengaging position where the lock arm 18 and the slider 60 do not engage along the connection and disconnection direction CSD. However, the rear end surfaces 20, 45 of the hook 19 and the lock 43 engage, as shown in FIG. 12. Simultaneously, the slider 60 is disengaged longitudinally from the lock arm 18 and moves forward by the release of the spring forces accumulated in the compression coil springs 61. The slider 60 stops at the front limit position due to the contact of the stopper projections 65 with the front end surfaces of the stopper grooves 49. At this stage, the lock arm 18 escapes into the escaping recess 66 and the engageable portion 64 is above the lock arm 18 over substantially its entire length, thereby preventing the lock arm 18 from being deformed resiliently up and away from the lock 43. In this way, the housings 10, 30 are inseparable because the lock arm 18 and the lock 43 are engaged and the slider 60 prevents the lock arm 18 from deforming in the unlocking direction. At this stage, the operable portions 67 of the slider 60 are backward from the front end of the male housing 10.

Figure 14A:
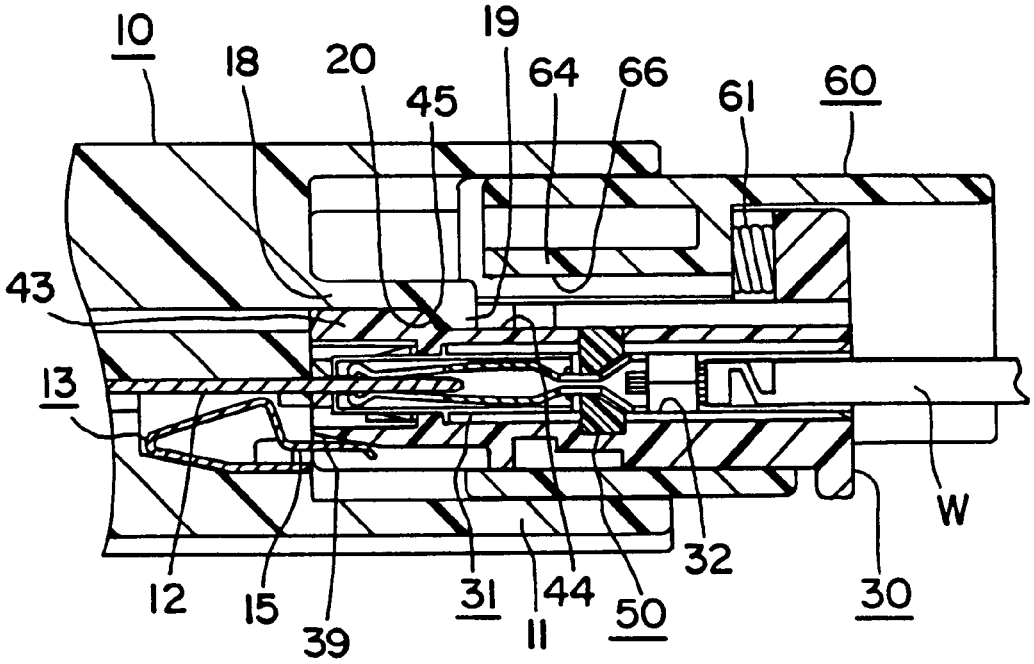
FIGS. 14A and 14B are a sectional views similar to FIGS. 8A and 8B, but showing a state where the slider is moved backward.
Figure 14B:
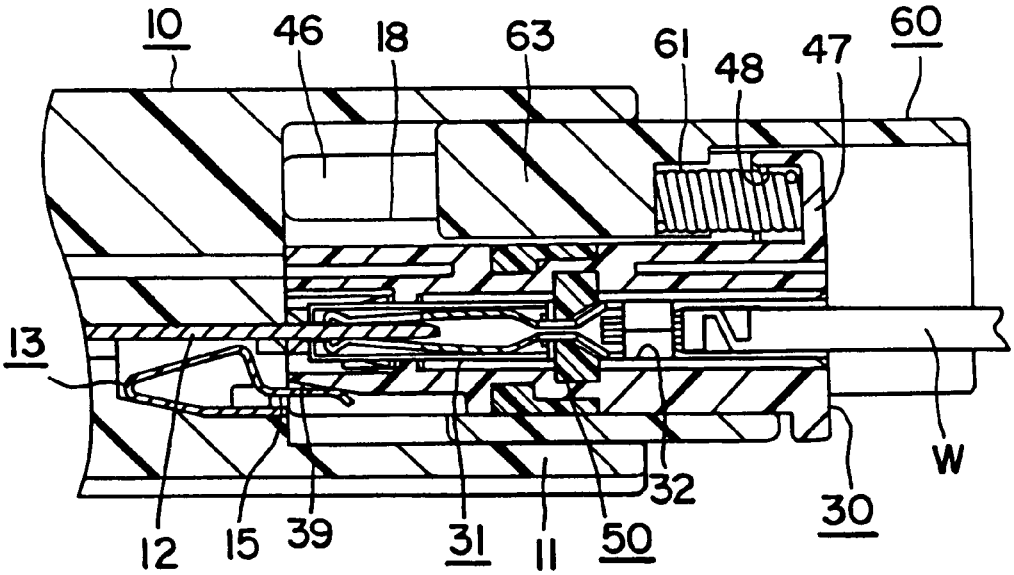
Figure 15A:
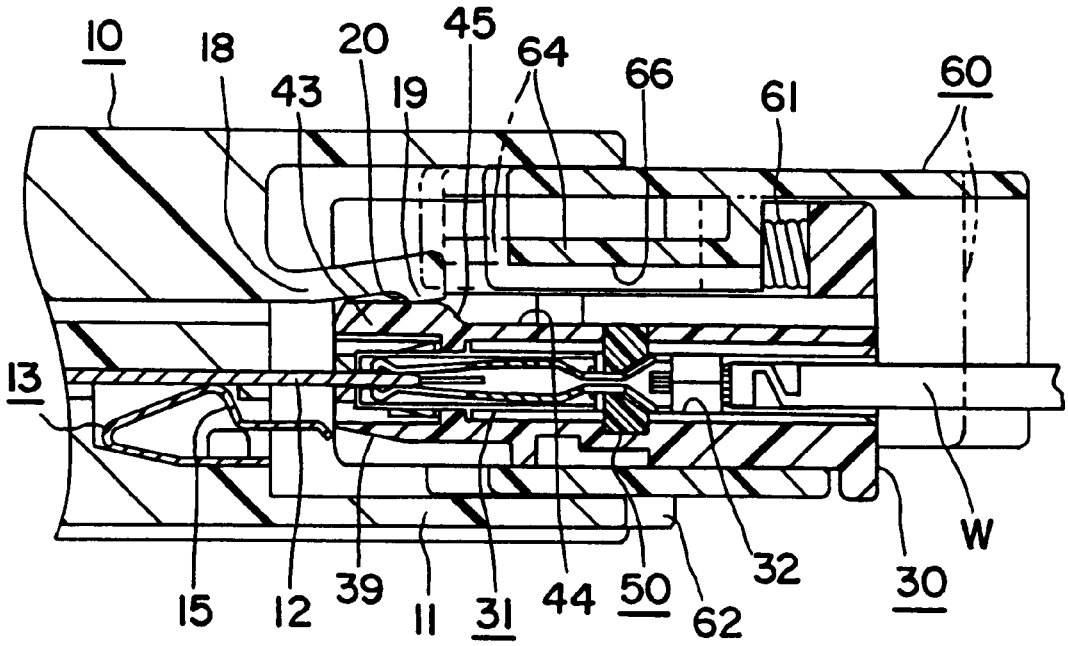
FIGS. 15A and 15B are sectional views similar to FIGS. 8A and 8B, but showing an intermediate stage of separation of the two housings, respectively.
Figure 15B:
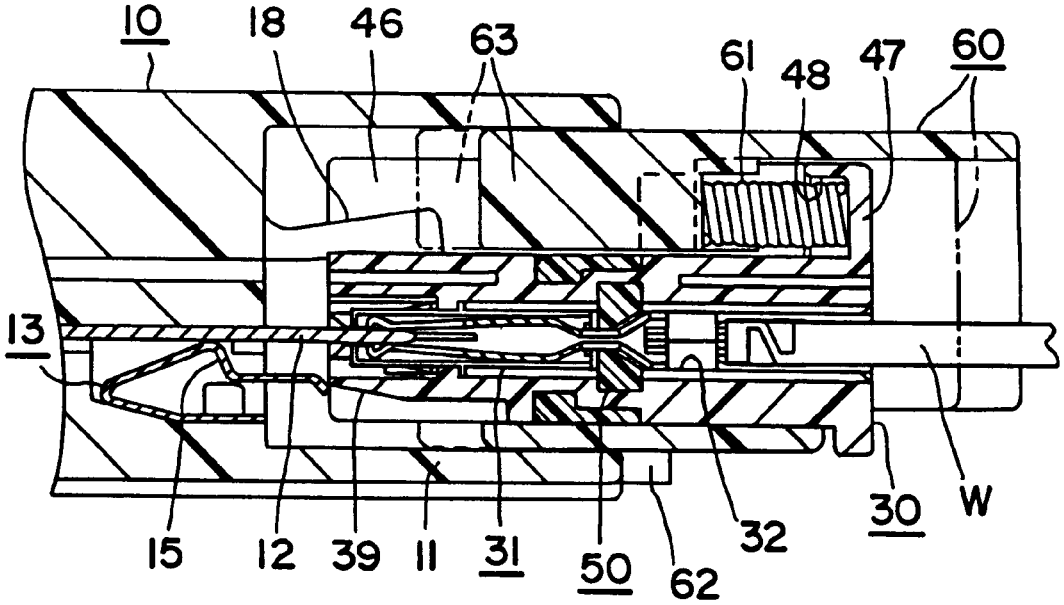

There are cases where the housings 10, 30 are separated for maintenance or another reason. In such cases, the slider 60 is moved back against the biasing forces of the compression coil springs 61 by gripping the operable portions 67 of the slider 60 with fingers of one hand and pulling them back. The space between the operable portions 67 and the male housing 10 enables fingers to be placed easily on the operable portions 67, and therefore facilitates operation of the slider 60. The slider 60 reaches the position shown in FIG. 14 where the engageable portion 64 is no longer above the lock arm 18. Therefore, the lock arm 18 is deformed automatically to the engaging position by the pulling force exerted on the slider 60 in the separating direction and by the guiding achieved by the slanted rear end surfaces 20, 45 of the hook 19 and the lock 43 (see FIG. 15). The slider 60 can be pulled further from this state to separate the female housing 30 from the receptacle 11 of the male housing 10. The resilient contact pieces 15 of the shorting terminal 13 disengage from the engaging recesses 39 during this process and again are brought resiliently into contact with the respective male tab terminals 12. In this way, the housings 10, 30 can be separated easily from each other by pulling the operable portions 67 of the slider 60, because the pulling direction of the slider 60 coincides with the separating direction of the female connector housing 30 from the male connector housing 10.

The separating operation may also be interrupted halfway for some reason. In such a case, the spring forces accumulated in the compression coil springs 61 are released and move the slider 60 forward. Thus, the engageable portion 64 of the slider 60 strikes against the front end face of the lock arm 18 in the engaging position shown in FIG. 15 to separate the housings 10, 30 forcibly. On the other hand, the slider 60 biased by the compression coil springs 61 strikes a rounded portion at the upper front end of the lock arm 18 when the separating operation is interrupted with the female housing 30 moved only slightly in the separating direction from its connected state with the male housing 10 and with the lock arm 18 only slightly deformed. Thus, the lock arm 18 is guided to its disengaging position and returns the housings 10, 30 to the connected state. In such a case, the separating operation is performed again. In this way, the housings 10, 30 are prevented from being left partly connected at the time of the separating operation.

As described above, the insufficiently inserted retainer 50 projects from the side surface of the female housing 30, and the detecting portion 69 of the slider 60 interferes with the projecting portion of the retainer 50. The retainer 50 that has been pushed to the full locking position is substantially flush with the side surface of the female housing 30. Accordingly, the retainer 50 does not interfere with the detecting portion 69 of the slider 60. Thus, the insufficient insertion of the retainer 50 can be detected based on whether the slider 60 can be moved back, i.e. whether or not the housings 10, 30 can be connected without interference.

The slider 60 has a frame shape. Therefore, the operable portions 67 can be spaced back from the male housing 10 with the housings 10, 30 properly connected. Accordingly, operability of the slider 60 during the separating operation of the housings 10, 30 is improved because the operable portions 67 can be grasped with the fingers. The retainer insertion hole 68 is formed in the frame-shaped slider 60. Thus, the retainer 50 can be inserted into the retainer mounting hole 41 of the female housing 30 while the slider 60 is assembled on the female housing 30.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The front inner edge of the retainer insertion hole, which serves as the detecting portion of the slider, may be bevelled to form a slanted surface. With such a slanted surface, if the slider is moved back with the retainer left at the position slightly before the full locking position, the retainer is pushed by the slanted surface at the inner edge of the detecting portion, thereby automatically pushing the retainer to the full locking position.

The slider is formed into a frame shape that surrounds the entire female housing in the foregoing embodiment. However, the frame may be formed, for example, into a channel shape that surrounds three side surfaces of the female housing or a L-shape that surrounds two side surfaces of the female housing. Alternatively, the slider may be straight and may be mounted into a side surface of the female housing adjacent to the side surface where the retainer mounting hole is formed. In this latter embodiment, a detecting portion that can interfere with the retainer may project from the slider.

Although the compression coil springs are mounted behind the slider in the foregoing embodiment, tension coil springs may be mounted before the slider according to the present invention.

Contrary to the foregoing embodiment, the slider and the compression coil springs may be mounted in the male housing and the lock arm may be provided in the female housing according to the present invention.

Although the male housing is integrally formed with a piece of equipment in the foregoing embodiment, the male housing mounted on an end of a wire drawn out from the equipment or may be an intermediate connector.

Although compression coil springs are described as biasing means, any other biasing means such as resilient rods, plate-like springs, etc. can be used according to the invention.

What is claimed is:

1. A connector having a housing for connection with a mating housing, comprising:

a plurality of substantially parallel cavities formed in the housing for accommodating terminal fittings;

a retainer mounting hole extending into the housing and intersecting the cavities;

a retainer mountable in the retainer mounting hole and movable between a partial locking position and a full looking position where the retainer enters the cavities to lock the terminal fittings; and a slider mounted to the housing and movable parallel to the cavities, the slider comprising a detecting portion for detecting whether the retainer is in the full locking position.

2. The connector of claim 1, wherein at least the detecting portion of the retainer is in sliding contact with a side surface of the housing that has the retainer mounting hole, the detecting portion being configured for interfering with the retainer when the retainer has not been moved completely from the partial locking position to the full locking position in the retainer mounting hole.

3. The connector of claim 2, wherein the retainer becomes substantially flush with the side surface of the housing when the retainer inserted to the full locking position in the retainer mounting hole.

4. The connector of claim 1, further comprising at least one biasing means for biasing the slider relative to the housing.

5. The connector of claim 1, wherein a retainer insertion hole through which the retainer is insertable is formed in a portion of the slider covering the side surface of the first connector housing with the retainer mounting hole, the retainer being insertable through the retainer insertion hole.

6. The connector of claim 5, wherein an edge of the retainer insertion hole forms the detecting portion that interferes the retainer, when the retainer is insufficiently inserted.

7. A connector having a housing, comprising:

a plurality of substantially parallel cavities formed in the housing for accommodating terminal fittings;

a retainer mounting hole extending into a side surface of the housing and intersecting the cavities;

a retainer mountable in the retainer mounting hole and movable between a partial looking position and a full locking position where the retainer enters the cavities to lock the terminal fittings; and a slider mounted at least partly around the housing and movable parallel to the cavities, the slider having a retainer insertion opening alignable with the retainer mounting hole and configured to permit insertion of the retainer through the retainer insertion hole and into the retainer mounting hole, the slider further comprising a detecting portion for detecting whether the retainer is in the full locking position.

8. The connector of claim 7, wherein housing comprises a front end, a rear end and a plurality of side wail extending between the ends, the cavities extending between the ends, the slider being substantially frame-shaped and surrounds the side walls of the housing.

9. A connector, comprising: a first housing having a plurality of substantially parallel cavities formed in the housing for accommodating terminal fittings, a retainer mounting hole extending into the housing and intersecting the cavities, a retainer mountable in the retainer mounting hole and movable between a partial locking position and a full locking position where the retainer enters the cavities to lock the terminal fittings, and a slider mounted to the housing and movable parallel to the cavities, the slider comprising a detecting portion for detecting whether the retainer is in the full locking position; and a second housing connectable with the first housing along a connecting and separating direction, the second housing having a resilient engaging portion resiliently deformable between a first position and a second position when the connector housings are connected properly with each other.

10. The connector of claim 9, wherein the resilient engaging portion is resiliently deformable in a direction intersecting the connecting and separating direction of the first and second connector housings.

11. The connector of claim 10, wherein the resilient engaging portion in the first position is engageable with the slider to push the slider against a biasing force of biasing means while the two connector housings are being connected and wherein the resilient engaging portion in the second position is disengaged from the slider along the connecting and separating direction of the first and second connector housings when the two connector housings are properly connected with each other.

12. The connector of claim 9, wherein the slider has a frame shape and substantially surrounds at least part of an outer surface of the first housing.

13. The connector of claim 9, wherein an operable portion is formed on the slider for moving the slider away from the second housing and against the biasing force of biasing means, the operable portion being spaced from a leading end of the second connector housing with the two connector housings properly connected.

14. A method for assembling a connector, comprising the following steps:

at least partly inserting terminal fillings into cavities of a first connector housing;

inserting a retainer into a retainer mounting hole in the first connector housing which is open sideways across the cavities to jock the terminal fittings into the corresponding cavities, and detecting whether the retainer is insufficiently inserted by means of a detecting portion of a slider on the first connector housing, the slider being movable forward and backward along a connecting and separating direction of the first connector housing with a mating second connector housing.

15. The method of claim 14, further comprising steps of connecting the first connector housing with a second connector housing thereby bringing a resilient engaging portion in the second connector housing into engagement with a portion of the first housing to displace the resilient engaging portion from a second position where the resilient engaging portion is not engageable with the slider along the connecting and separating directions of the connector housings to a first position where the resilient engaging portion is engageable with the slider along the connecting and separating directions.

16. The method of claim 15, wherein at least two outer circumferential surfaces of the first connector housing are surrounded by the slider.

17. The method of claim 14, wherein the slider engaged with the resiliently engaging portion located in the first position is moved backward both at an intermediate stage of connecting the connector housings and at an intermediate stage of separating the connector housings, and when the connector housings are connected properly with each other, the resiliently engaging portion is displaced resiliently to the second position and is not engageable with the slider along the connecting and separating directions and the slider is moved forward.

* * * * *